US006793534B2

(12) United States Patent
Cheng et al.

(10) Patent No.: US 6,793,534 B2
(45) Date of Patent: Sep. 21, 2004

(54) POWER DISTRIBUTION OUTLET WITH FUSE

(76) Inventors: Wen Tsung Cheng, No. 78 Chao-Chou St., Taoyuan (TW); Wen Ho Cheng, No. 78 Chao-Chu St., Taoyuan (TW)

( * ) Notice: Subject to any disclaimer, the term of this patent is extended or adjusted under 35 U.S.C. 154(b) by 0 days.

(21) Appl. No.: 10/424,071

(22) Filed: Apr. 28, 2003

(65) Prior Publication Data

US 2004/0166737 A1 Aug. 26, 2004

(30) Foreign Application Priority Data

Feb. 21, 2003 (TW) ..... 92202780 U

(51) Int. Cl.[7] ..... H01R 13/68

(52) U.S. Cl. ..... 439/621; 439/622; 439/763; 439/764

(58) Field of Search ..... 439/621, 622, 439/761–764

(56) References Cited

U.S. PATENT DOCUMENTS 6,162,098 A * 12/2000 Cheng et al. ..... 439/621

6,165,020 A * 12/2000 Cheng et al. ..... 439/621

* cited by examiner

*Primary Examiner*—Gary Paumen

(57) ABSTRACT

A power distribution outlet with a fuse, having a battery connector, a connecting block, a distributing block, an insulation plate, a fuse, and an insulation housing is disclosed. The battery connector is connected to the electrode of the battery. The connecting block has a wire to electrically connect the battery connector. The distributing block has a plurality of wire inlets for connecting a plurality of power cords. The connecting block and the distributing block are fixed on an insulation plate and insulated to each other thereby. The fuse electrically connects the connecting block and the distributing block, which are enclosed in the insulation housing. The above structure allows multiple power cords to be conducted with the battery at the same time, while the fuse can be easily inspected and replaced to protect the electronic products connected to the power cords, and the structure is easily fabricated.

11 Claims, 9 Drawing Sheets

POWER DISTRIBUTION OUTLET WITH FUSE

BACKGROUND OF THE INVENTION

The present invention relates to a power distribution outlet and, more particularly, the present invention relates to a power distribution outlet allowing a multiplicity of electronic products to be systematically connected to a car battery. The power distribution outlet has an easily assembled/dissembled fuse providing the convenience and safety for the application of the electronic products.

The typical car is equipped with a variety of power-consuming electronic products, such as the generator, lamp, car stereo and air conditioning system. However, the amount of car batteries providing electricity to the electronic products is limited. When the number of the electronic products is larger than the amount of the car batteries, the electric wiring layout of the power-consuming electric products becomes very crucial. As the new models of cars are continuously developed, in addition to the improvement of performance and safety, comfort level, convenience and added values are also emphasized. Therefore, cars are often promoted with some advanced equipments such as the expensive electronic equipment (for example, the ABS anti-lock breaking system, GPS navigation system and etc.), or high-end video and audio system. Consequently, the amount of required electric wires is increased. However, in the traditional design, the wires are directly connected to the electrode of the car battery via respective ring clips formed on the ends thereof. This causes the inconvenience for individually connecting and disconnecting. Further, the overlapping connection of the electric wires causes great danger. Therefore, the industry has developed some special battery distribution outlet to overcome the problem.

Referring to FIGS. 1 and 2, a conventional power distribution outlet 8 is illustrated. The power distribution outlet 8 comprises a connector body 80 and a connection socket 85. The connector body 80 comprises a clamp portion 81, a wire inlet 82 and a slot 83. The clamp portion 81 includes a bolt 810 for firmly connecting the electrode of a car battery (not shown). More than one wire inlets 82 may be formed to accommodate filaments 90 of power cords 9. The filaments 90 are fixed by the pressing screws 820. The slot 83 is in the shape of a dovetail. The connection socket 85 includes an insulator block 86 and mutually insulated first and second conductor blocks 87 and 88 enclosed in the insulator block 86. The first conductor block 87 comprises a board 870 extending from the insulator 86. The board 870 has a shape matching the dovetail shape of the slot 83, such that the connector body 80 is conducted to the connection socket 85 by engaging the board 870 with the slot 83. Another wire inlet 880 is formed on the second conductor block 88. More than one wire inlets 880 can be formed according to specific requirement for accommodating the filaments 90 of another power cords 9. The power cord 9 is firmly attached by pressing the screw 881 towards the filament 90. The first and second conductor blocks 87 and 88 further comprise electrode portions 871, 882, respectively, allowing the fuse 89 to be inserted. Thereby, many electric wires can be conducted via the power distribution outlet 8 to deliver electricity, and the electronic products connected by the electric wires are protected by the fuse 89.

However, in the above power distribution outlet 8, the connector body 80 and the connection socket 85 are connected by snapping the board 870 with the slot 83, while the slot 83 and the board 870 are in dovetail shape. The fabrication precision is highly demanded to cause great process difficulty.

According to the above, the conventional power distribution outlet still has inconvenience and drawbacks to be improved.

Therefore, the Applicant has performed researches and tests to develop a design based on the relative theory and years of working experience in this field to improve the inconvenience and drawback of the conventional design.

BRIEF SUMMARY OF THE INVENTION

The present invention provides a power distribution outlet in which a fuse can be easily installed and multiple power cords to be plugged tidily and stably connected to the battery. The power distribution outlet provided visibly inspected fuse could be easily replaced to protect the electronic products. Further, the power distribution outlet is easily for production.

The power distribution outlet with a fuse provided by the present invention comprises a battery connector, a connecting block, a distributing block, an insulation plate, a fuse and an insulation housing. The battery connector, the connecting block and the distributing block are conductors. The battery connector includes a clip portion and a plurality of wire inlets. The clip portion is clamped with the electrode of the battery. The connecting block includes a joining surface, a first electrode portion and a wire inlet for receiving one end of a wire. The other end of the wire is fixed in the wire inlet of the battery connector, such that the connecting block and the battery connector are electrically connected. The distributing block includes a connecting surface, a second electrode portion and a plurality of wire inlets. The connecting surface has a shape matching the joining surface of the connecting block, and the second electrode portion is disposed aligned with the first electrode portion. The wire inlets are used for receiving power cords. The insulation plate has a base and a sheet extending upward from the base. The sheet has a shape matching the shapes of the joining surface and the connecting surface. Therefore, the connecting block and the distributing block are insulated and fixed on the base at two sides of the sheet. The fuse has two conducting parts connected to the fust and second electrode portions, respectively. The connecting and distribution blocks are electrically conducted to each other thereby. The connecting and distribution blocks are then enclosed by the insulation housing.

BRIEF DESCRIPTION OF THE DRAWINGS

These, as well as other features of the present invention, will become apparent upon reference to the drawings wherein.

DETAILED DESCRIPTION OF THE INVENTION

Figure 1:
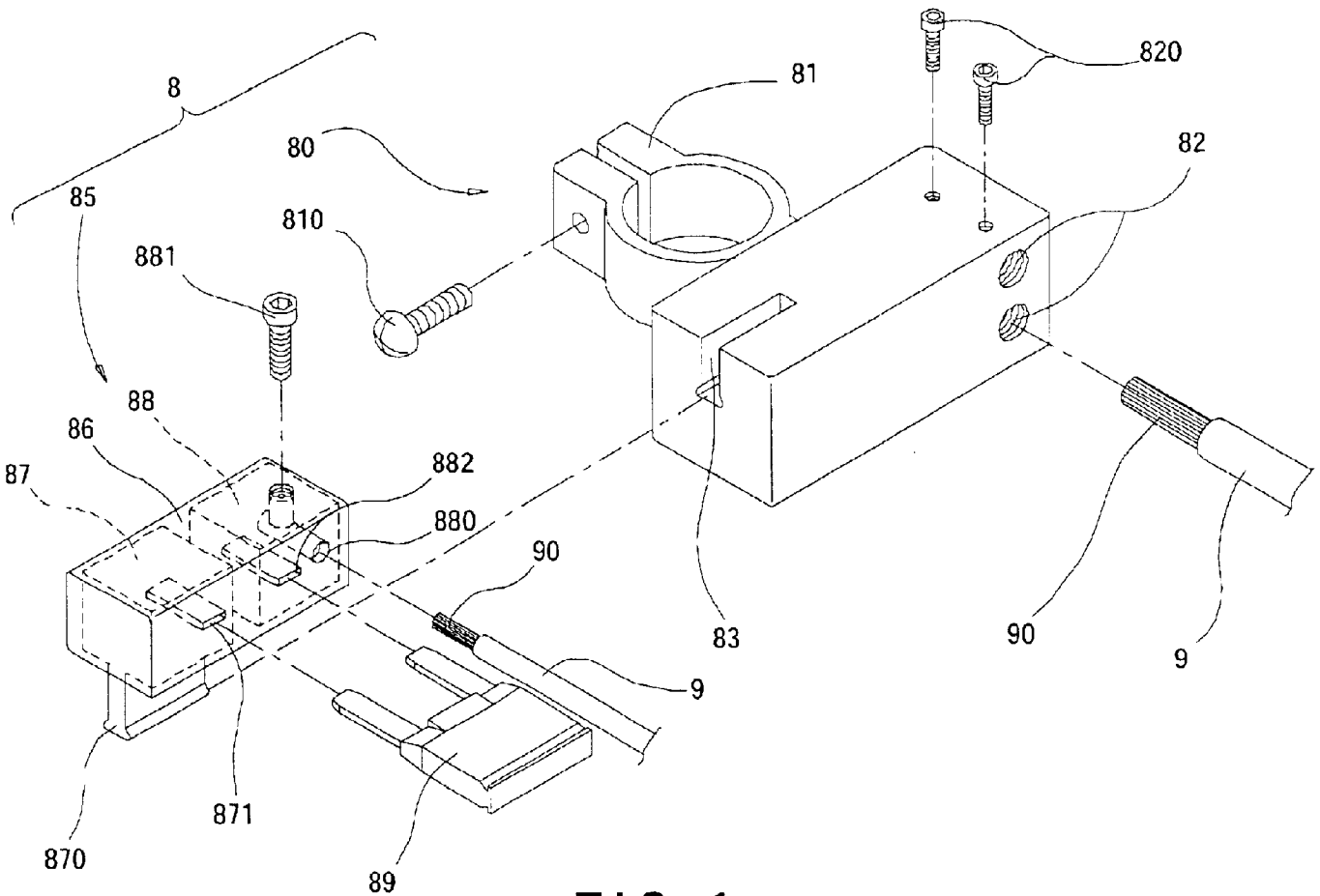
FIG. 1 PRIOR ART
FIG. 1 shows a perspective exploded view of a conventional power distribution outlet.
Figure 2:
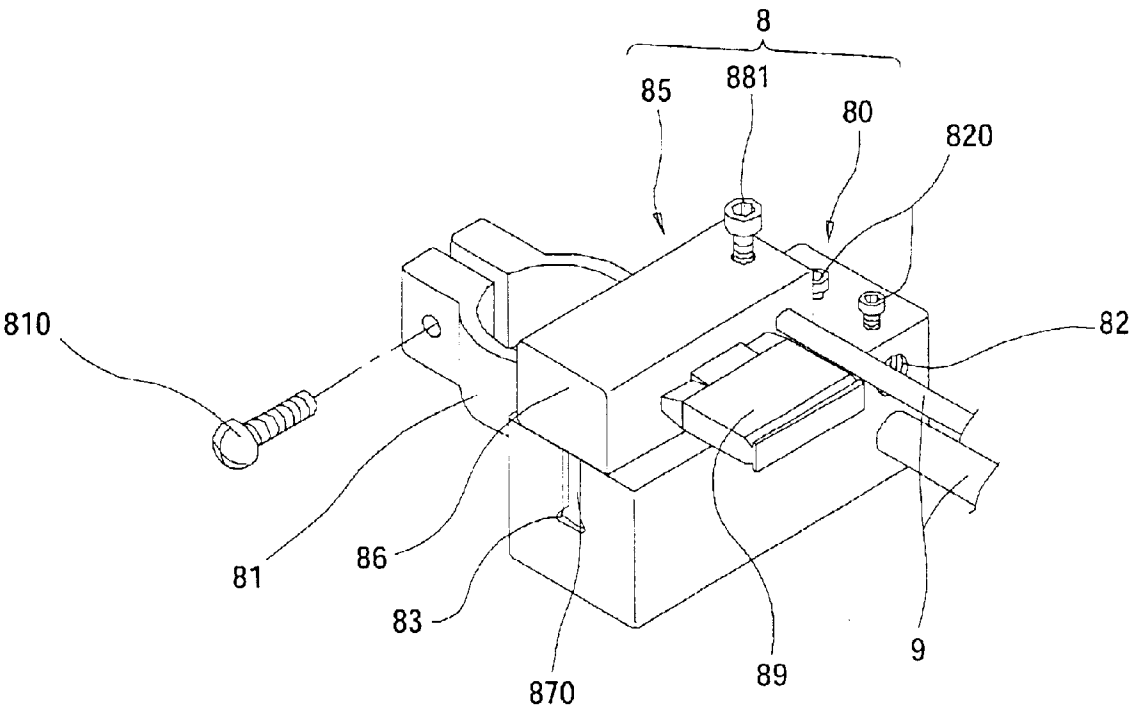
FIG. 2 PRIOR ART
FIG. 2 shows a perspective view of the assembly of the conventional power distribution outlet.
Figure 3:
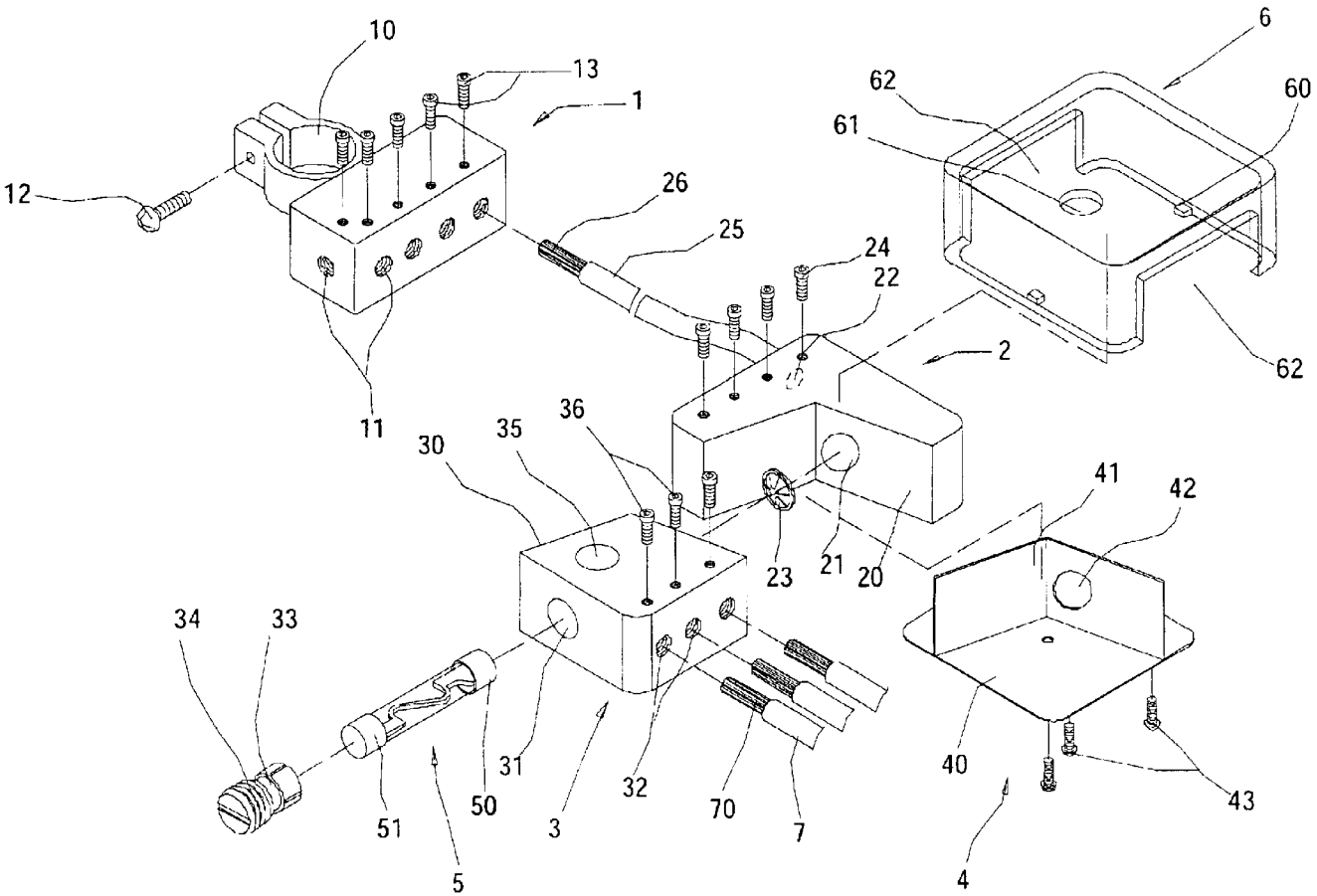
FIG. 3 shows a perspective exploded view of a power distribution outlet with a fuse provided in a first embodiment of the present invention.
Figure 4:
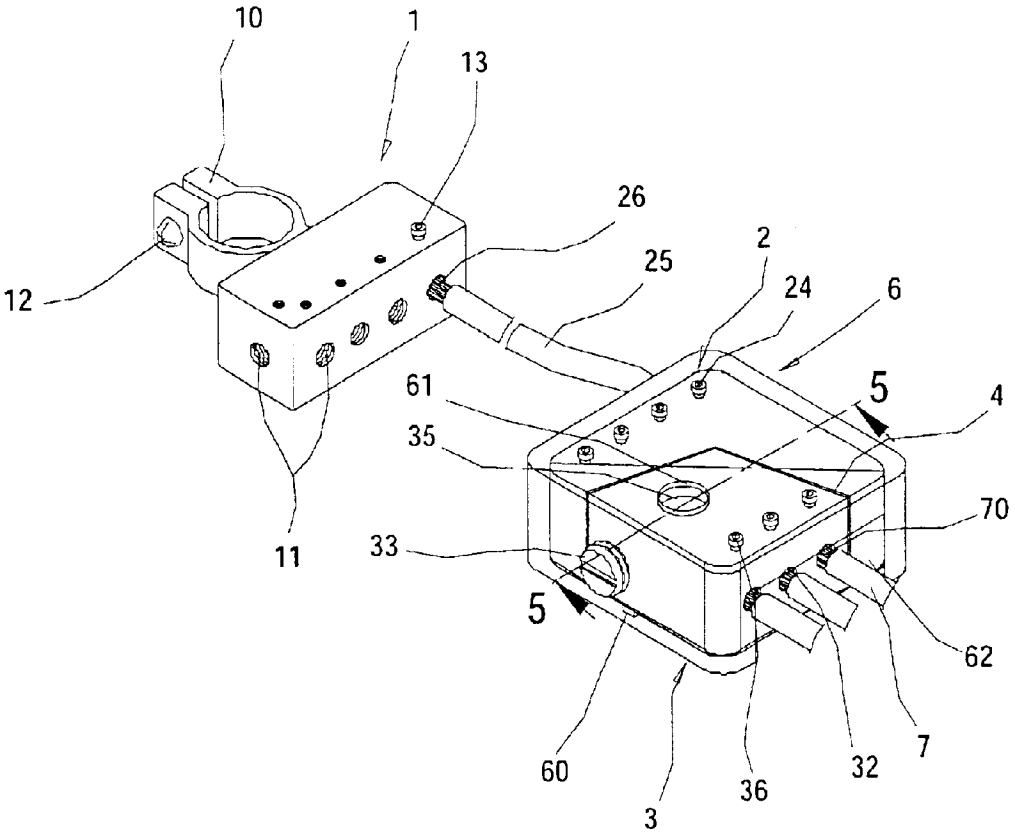
FIG. 4 shows a perspective view of the assembly of the power distribution outlet with a fuse provided by the present invention.
Figure 5:
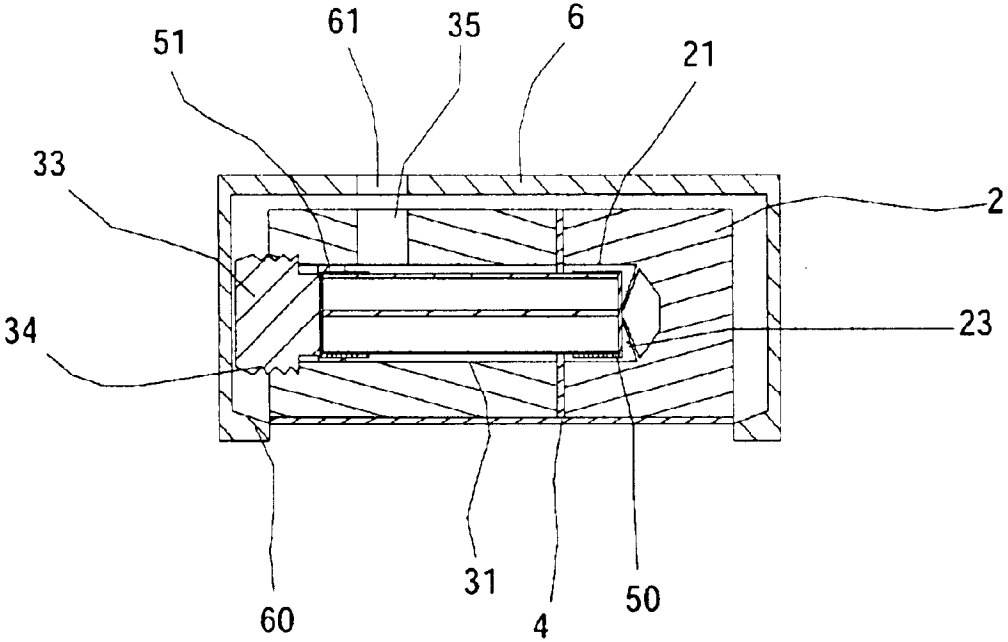
FIG. 5 shows a cross-sectional view along line 5—5 of FIG. 4.

Referring to FIGS. 3 to 5, the present invention provides a power distribution outlet with a fuse, including a battery connector 1, a distributing block 3, an insulation plate 4, a fuse 5 and an insulation housing 6.

The battery connector 1 is a conductor and includes a clip portion 10 and a plurality of wire inlets 11. The clip portion 10 includes a bolt 12, while the wire inlets 11 each comprises a pressing screw 13.

The connecting block 2 is a conductor and includes a joining surface 20, a first electrode portion 21 and a wire inlet 22. The joining surface 20 includes two inwardly inclined planes joining each other with a joint angle. The first electrode portion 21 includes a circular hole formed on the joining surface 20. Inside of the first electrode portion 21, there installs a conductive splint 23. The wire inlet 22 includes a pressing screw 24.

The distributing block 3 is a conductor and includes a connecting surface 30, a second electrode portion 31 and a plurality of wire inlets 32. The connecting surface has a configuration matching the geometry of the joining surface 20 of the connecting block 2. That is, the connecting surface 30 has two planes inclined outwardly from the joint thereof. The second electrode portion 31 includes a slot through the distributing block 3. The second electrode portion 31 is preferably aligned with the first electrode portion 21, allowing the connecting block 2 and the distributing block 3 joining together subsequently. External to the second electrode portion 31, a terminal cap 33 is installed. The terminal cap 33 is also a conductor with threads 34 formed at a periphery thereof. By the threads 34, the terminal cap 33 can be screwed into the second electrode portion 31. A window 35 is formed on the second electrode portion 31. Each wire inlet 32 also includes a pressing screw 36.

The insulation plate 4 includes a base 40 and a sheet 41 extending upwardly from the base 40. The sheet 41 has a structure conformal to the joining surface 20 and the connecting surface 30. A hole 42 is formed on the sheet 41 at the position where the first electrode portion 21 is to be disposed.

Two ends of the fuse 5 comprise conducting parts 50, 51, respectively.

The insulation housing 6 includes a plurality of stop blocks 60 at a bottom edge thereof, a hole 61 at the position wherein the fuse 5 is disposed, and openings 62 at the positions for installing the wire inlets 22 and 32.

The clip portion 10 of the battery connector is clamped with the electrode of the battery (not shown) via the bolt 12. Inside of the wire inlet 22 of the connecting block 2, filaments 26 at one end of a wire 25 of the connecting block 2 are fixed by pressing screw 13, and the filaments 26 at the other end of the wire 25 are fixed in the wire inlet 11 of the battery connector 1, such that the connecting block 2 is electrically conducted to the battery connector 1. The connecting block 2 and the distributing block 3 are disposed adjacent to two opposite sides of the sheet 41 and fixed on the base 40 of the insulation plate 4 via screws 43. The fuse 5 is inserted through the second electrode portion 31 to the first electrode portion 21, and then secured in the distributing block 3 and the connecting block 2 by threading the terminal cap 33 into the second electrode portion 31. Therefore, the conducting part 50 of the fuse is in contact with the conductive splint 23 of the first electrode portion 21, and the conducting part 51 at the other end thereof is in contact with the terminal cap 33. Thereby, the connecting block 2 and the distributing block 3 are electrically conducted via the fuse 5. The insulation housing 6 is then engaged with the base 40 by the stop blocks 60, so as to enclose the connecting block 2 and the distributing block 3 therein. The openings 61 and 62 provide convenience of accessing the fuse 5 and plugging the wires 25 and the power cords 7.

By the above structure, the power cords 7 can deliver electricity by plugging the filaments 70 thereof into the wire inlets 32 of the distributing block 3 and connecting to the positive electrode of the battery via the terminal cap 33, the conducting parts 50, 51 of the fuse 5, the connecting block 2, the wire 25 and the battery connector 1. When it is suspected that the fuse 5 might be blown or damaged, the user can check from the window 35 of the distributing block 3 aligned over the fuse 5. Therefore, without dissembling the whole structure, the fuse 5 can be inspected and replaced. The user can simply removes the terminal cap 33 from the second electrode portion 31 to replace the fuse 5.

Figure 6:
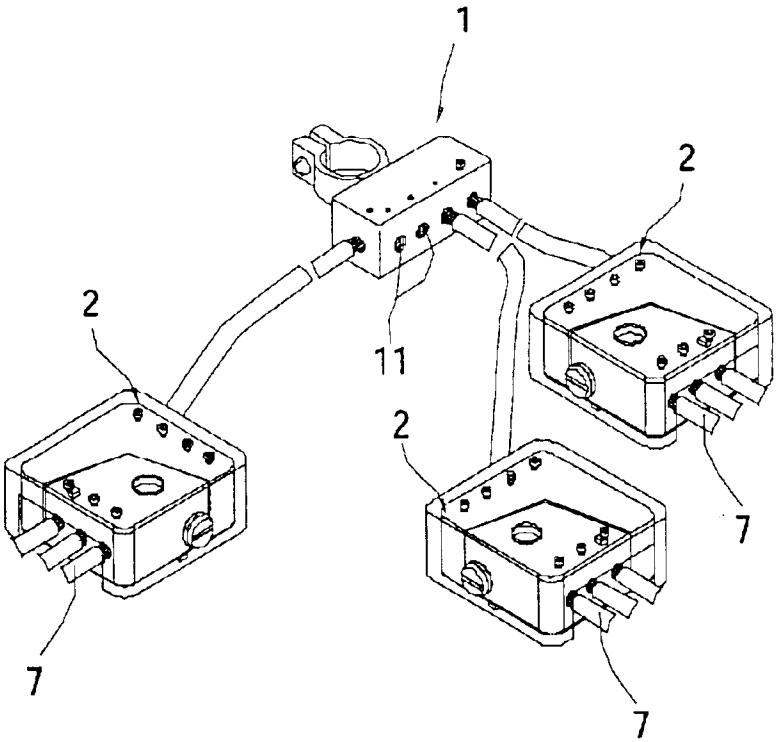
FIG. 6 shows a perspective view of the application status of the power distribution.

As shown in FIG. 6, the battery connector 1 comprises a plurality of wire inlets 11 to provide a plurality of connecting blocks 2 to be conducted at the same time. This provides the same functions of electrically conducting multiple power cords 7 with one battery.

Figure 7:
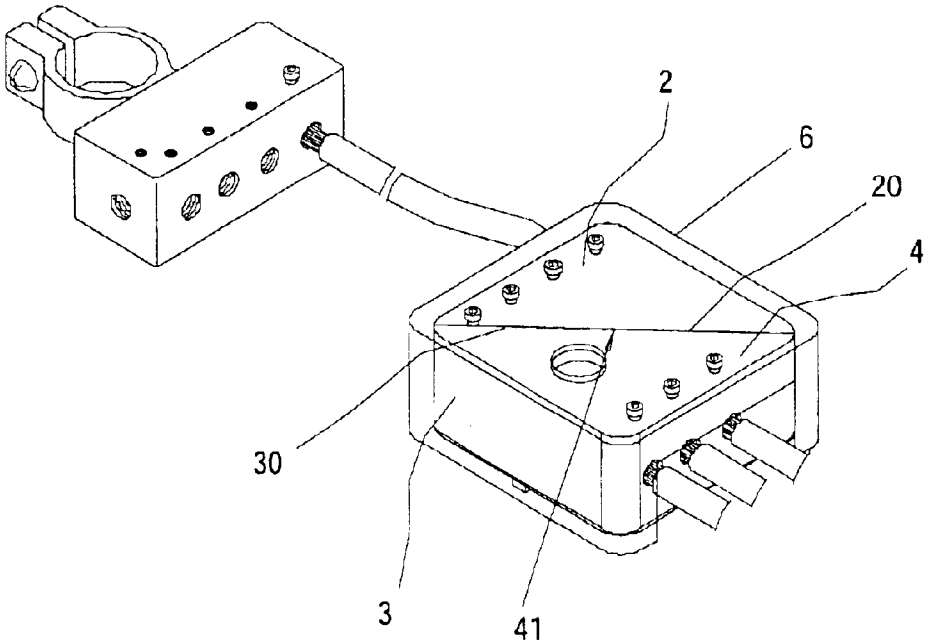
FIG. 7 shows a perspective view of a second embodiment of the power distribution outlet with a fuse provided by the present invention.

FIG. 7 shows a second embodiment of the present invention. The joining surface 20 and the connecting surface 30 each includes a single plane conformal to each other. Consequently, the sheet 41 insulating and connecting the connecting block 2 and the distributing block 3 has a flat geometry.

Figure 8:
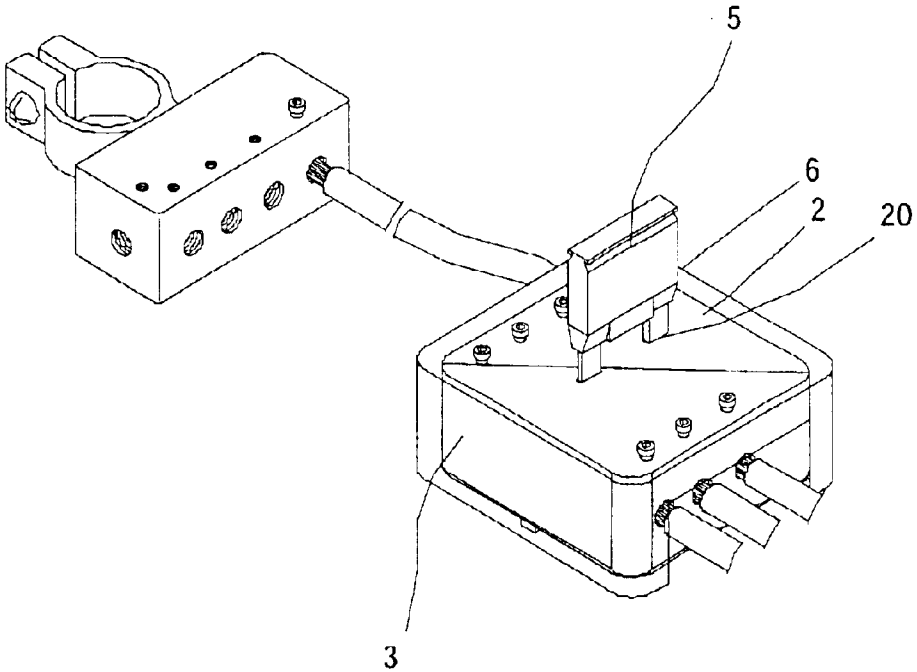
FIG. 8 shows a perspective view of a third embodiment of the power distribution outlet with a fuse provided by the present invention.

FIG. 8 shows a third embodiment of the present invention, in which the first and second electrode portions 21 and 31 each includes a vertical slot across the connecting and distributing blocks 2 and 3, respectively. Therefore, the fuse 5 can be inserted across the connecting block 2 and the distributing block 3.

Figure 9:
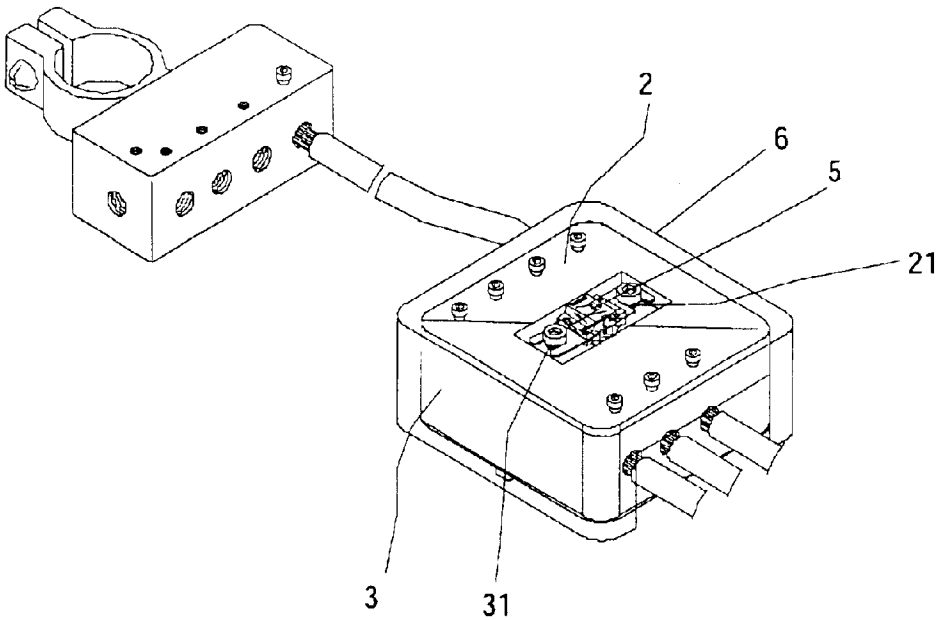
FIG. 9 shows a perspective view of a fourth embodiment of the power distribution outlet with a fuse provided by the present invention.

Referring to FIG. 9, a fourth embodiment of the present invention is illustrated. The first electrode portion 21 and the second electrode portion 31 each includes a threaded hole, allowing the fuse 5 to be threaded through the connecting block 2 and the distributing block 3, so as to provide the conduction therebetween.

Accordingly, the power distribution outlet provided by the present invention does not only provide the connection of a multiplicity of power cords to the car battery, but also properly arrange the power cords to suppress the hazard of unwanted connection and overlap between the power cords. In addition, the fuse is easily inspected and replaced to control the magnitude of electricity, such that the expensive electronic products can be protected. Further, the fabrication includes simply process such as drilling, threading to install the fuse for conducting the connecting block and the distributing block. Therefore, the fabrication is effectively simplified compared to the fabrication of the dovetail slot and board.

This disclosure provides exemplary embodiments of a child safety blind. The scope of this disclosure is not limited by these exemplary embodiments. Numerous variations, whether explicitly provided for by the specification or implied by the specification, such as variations in shape, structure, dimension, type of material or manufacturing process may be implemented by one of skill in the art in view of this disclosure.

What is claimed:

1. A power distribution outlet, to connect an electrode of a battery to a plurality of power cords, comprising:

a battery connector, having a clip portion and a plurality of wire inlets, wherein the clip portion is used to connect the electrode of the battery;

a connecting block, having a joining surface, a first electrode portion, a wire inlet, and a wire having one end fixed in the second wire inlet and the other end connected to one of the wire inlets of the battery connector;

a distributing block, having a connecting surface, a second electrode portion and a plurality of wire inlets, wherein the connecting surface is conformal to the joining surface, the second electrode portion is aligned with the first electrode portion, and the wire inlets are used to receive the power cords;

an insulation plate, to fix the connecting block and the distributing block into a single body thereon, so as to insulate the connecting block from the distributing block;

a fuse, having two conductive parts coupled to the connecting block and the connecting block respectively, so as to conduct the connecting block with the distributing block; and an insulation housing, to enclose the connecting block and the distribution block therein.

2. The power distribution outlet according to claim 1, wherein each of the wire inlets comprises a pressing screw.

3. The power distribution outlet according to claim 1, wherein the joining surface comprises two inwardly inclined planes merged each other from two sides.

4. The power distribution outlet according to claim 1, wherein the joining surface comprises a single plane.

5. The power distribution outlet according to claim 1, wherein the first electrode portion includes a circular hole formed on the joining surface and a conductive splint installed therein, and the second electrode portion includes a slot penetrating through the distributing block and aligned with the circular hole, such that the first and second electrode portions are merged into a single hole allowing the fuse inserted therethrough, and the second electrode portion further comprising a terminal cap, the terminal cap is a conductor, such that the connecting block and the distributing blocks are conducted via the fuse, the terminal cap and the conductive splint.

6. The power distribution outlet according to claim 5, wherein the distribution block further comprises a window aligned over the second electrode portion.

7. The power distribution outlet according to claim 1, wherein the insulation housing comprises a plurality of stop blocks at a bottom edge thereof to snap with the insulation plate, so as to enclose the connecting and distributing blocks therein, the insulation housing further comprises an opening at a position where the fuse is inserted in the distribution block, and an opening at a position wherein the power cords are plugged in.

8. The power distribution outlet according to claim 1, wherein the insulation plate includes a base and a sheet extending upwardly from the base, the sheet is conformal to the joining surface and the distributing surface, such that the connecting block and the distributing block are fixed adjacent to two opposite sides of the sheet on the base.

9. The power distribution outlet according to claim 1, wherein the connecting block and the distributing block are fixed on the base via a plurality of screws.

10. The power distribution outlet according to claim 1, wherein the first and second electrode portions include slots allowing the fuse to plug in, so as to electrically connect the connecting block and the distributing block.

11. The power distribution outlet according to claim 1, wherein the first and second electrode portions include threaded holes allowing the fuse to be threaded in, so as to electrically connect the connecting block and the distributing block.

* * * * *